US010155385B2

(12) United States Patent
Hiramoto et al.

(10) Patent No.: US 10,155,385 B2
(45) Date of Patent: Dec. 18, 2018

(54) LIQUID EJECTION HEAD

(71) Applicant: CANON KABUSHIKI KAISHA, Tokyo (JP)

(72) Inventors: Atsushi Hiramoto, Machida (JP); Ryoji Kanri, Zushi (JP); Yoshiyuki Fukumoto, Kawasaki (JP); Atsunori Terasaki, Kawasaki (JP); Atsushi Teranishi, Kawasaki (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/829,011

(22) Filed: Dec. 1, 2017

(65) Prior Publication Data

US 2018/0170047 A1 Jun. 21, 2018

(30) Foreign Application Priority Data

Dec. 15, 2016 (JP) ..... 2016-243420

(51) Int. Cl.
*B41J 2/05* (2006.01)
*B41J 2/14* (2006.01)
*B41J 2/16* (2006.01)

(52) U.S. Cl.
CPC ..... *B41J 2/1433* (2013.01); *B41J 2/1404* (2013.01); *B41J 2/1603* (2013.01); *B41J 2/1628* (2013.01); *B41J 2/1631* (2013.01)

(58) Field of Classification Search
CPC ..... B41J 2/1404; B41J 2/1433; B41J 2/162; B41J 2/1603; B41J 2/1631
USPC ..... 347/20, 40, 44, 47, 65
See application file for complete search history.

(56) References Cited

U.S. PATENT DOCUMENTS

| | | | |
|---|---|---|---|
| 6,464,345 | B2 | 10/2002 | Kubota et al. |
| 6,663,229 | B2 | 12/2003 | Komuro et al. |
| 7,036,909 | B2 | 5/2006 | Kubota et al. |
| 7,513,601 | B2 | 4/2009 | Asai et al. |
| 8,366,951 | B2 | 2/2013 | Morisue et al. |
| 8,376,525 | B2 | 2/2013 | Asai et al. |
| 8,419,168 | B2 | 4/2013 | Okano et al. |
| 8,518,725 | B2 | 8/2013 | Terasaki et al. |

(Continued)

FOREIGN PATENT DOCUMENTS

JP 2011-161915 A 8/2011

*Primary Examiner* — An Do
(74) *Attorney, Agent, or Firm* — Fitzpatrick, Cella, Harper & Scinto

(57) ABSTRACT

A liquid ejection head includes: a substrate including an energy-generating element; a flow path forming member including a discharge port and having a liquid flow path formed between the flow path forming member and the substrate; and a plurality of through-passages passing through the substrate, each of the through-passages including a first through-passage part serving as a common liquid chamber and a plurality of second through-passage parts communicating with the first through-passage part, wherein a separation wall separating the adjacent first through-passage parts includes a plate-shaped member separating the adjacent first through-passage parts and approximately vertical to a substrate in-plane direction and, at least one protrusion protruding from the plate-shaped member in the substrate in-plane direction and contacting a bottom portion of the first through-passage part.

20 Claims, 9 Drawing Sheets

(56) References Cited

U.S. PATENT DOCUMENTS 9,096,063 B2 * 8/2015 Kubota ..... B41J 2/14145
9,138,995 B2 * 9/2015 Mizutani ..... B41J 2/1404

* cited by examiner

LIQUID EJECTION HEAD

BACKGROUND OF THE INVENTION

Field of the Invention

The present invention relates to a liquid ejection head.

Description of the Related Art

Structures obtained by microfabricating silicon are widely used as MEMS-field and electromechanical functional devices. An example thereof is a liquid ejection head ejecting liquid. For example, the liquid ejection head is used as a liquid ejection head of a liquid ejection recording type in which an ejected droplet is placed onto a recording medium for recording. The liquid ejection head of the liquid ejection recording type includes a substrate provided with an energy-generating element generating energy for use in ejecting liquid and a discharge port ejecting liquid supplied from a liquid supply port provided in the substrate. In a recent liquid ejection recording device, there is a demand for improvement in printing performance such as high resolution and high-speed printing and size reduction and densification of the liquid ejection head in manufacture.

Japanese Patent Application Laid-Open No. 2011-161915 proposes a method for processing a silicon substrate enabling a structure provided with a plurality of individual supply ports communicating with a common liquid chamber with high forming accuracy to be obtained at a high yield. In this method, the silicon substrate is subject to the following two-stage etching process. First, dry etching serving as first etching is performed to form a recess serving as a common liquid chamber. Subsequently, using as a mask an intermediate layer provided on a bottom portion of the recess and having a plurality of openings formed therein, second etching is performed to form a plurality of individual supply ports. In this manner, the silicon substrate having the plurality of individual supply ports communicating with the common liquid chamber constituting the recess is formed.

SUMMARY OF THE INVENTION

According to the present invention, there is provided a liquid ejection head including: a substrate including an energy-generating element; a flow path forming member including a discharge port and having a liquid flow path formed between the flow path forming member and the substrate; and plurality of through-passages passing through the substrate, each of the through-passages including a first through-passage part serving as a common liquid chamber and a plurality of second through-passage parts communicating with the first through-passage part, wherein a separation wall separating the adjacent first through-passage parts includes a plate-shaped member separating the adjacent first through-passage parts and approximately vertical to a substrate in-plane direction and, at least one protrusion protruding from the plate-shaped member in the substrate in-plane direction and contacting a bottom portion of the first through-passage part.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Substrate processing using dry etching enables highly anisotropic microfabrication and is thus suitable for forming a high-aspect-ratio vertical shape in a silicon substrate. In a liquid ejection head, by forming vertical common liquid chambers by means of dry etching and narrowing a beam width of a separation wall (wall width) produced between the adjacent common liquid chambers, the substrate (chip) size can be shrunk.

Meanwhile, in the present specification, the term "beam" means a plate-shaped member (particularly, a flat-plate-shaped member) which separates common liquid chambers adjacent to each other in a substrate in-plane direction and which is approximately vertical to the substrate in-plane direction. Also, "approximately vertical" includes not only a strictly vertical shape but also a tapered shape generated at the time of processing. That is, displacement from a vertical shape caused by processing accuracy is allowed. Similarly, "approximately parallel" includes not only a strictly parallel state, and displacement from a parallel state caused by processing accuracy is allowed.

Figure 9A:
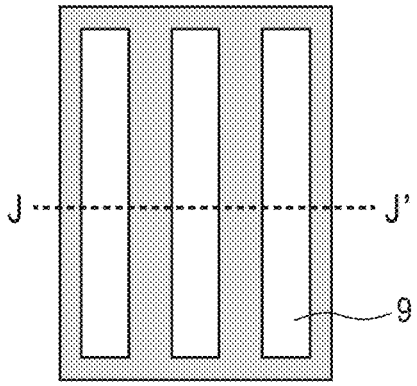
FIGS. 9A, 9B, 9C and 9D are schematic views illustrating a conventional problem along with size reduction of a liquid ejection head.
Figure 9B:
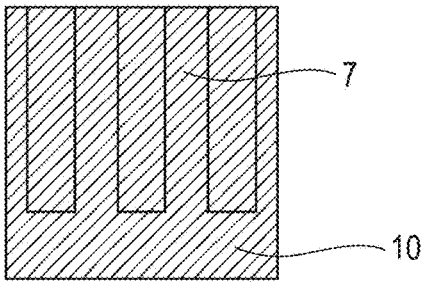
Figure 9C:
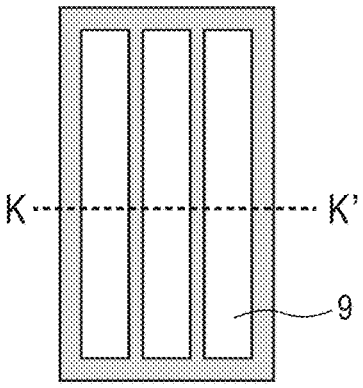
Figure 9D:
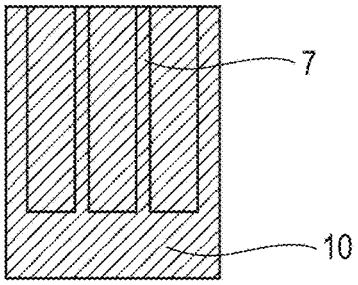

FIGS. 9A to 9D are schematic views illustrating shapes when patterns formed in a silicon substrate are processed vertically. FIGS. 9A and 9C are upper views, FIG. 9B is a cross-sectional view along the cross-section J-J' in FIG. 9A, and FIG. 9D is a cross-sectional view along the cross-section K-K' in FIG. 9C.

When rectangular opening patterns 9 as in FIG. 9A are processed vertically in a silicon substrate 10, a vertical separation wall 7 is formed between the adjacent opening patterns as in FIG. 9B. In a case in which the distance between the adjacent patterns is reduced to narrow the beam width of the separation wall 7, the patterns can be arranged in a high-density state. Accordingly, the chip size of the liquid ejection head can be shrunk (reduced).

However, in a case in which the beam width of the separation wall is narrowed and shrunk as in FIG. 9C, and in which the silicon substrate is processed deeply, the separation wall is in a vertical shape in which the beam width and the depth are in a high aspect ratio (beam depth/beam width) as in FIG. 9D. For this reason, the mechanical strength of the separation wall is lowered, and the separation wall is vulnerable to a force in a horizontal direction to the substrate surface. In the case of such a shape, the separation wall 7 may be broken when the force in the horizontal direction to the substrate surface is applied to the side surface of the separation wall.

In this manner, in the shrinking method of simply shrinking the distance between the opening patterns, the separation wall will be in the high aspect shape and decrease its strength when the substrate is etched deeply. Thus, the separation wall may be broken during manufacture of the liquid ejection head or during use of the liquid ejection head recording device.

An object of the present invention is to provide a liquid ejection head restricting a decrease of mechanical strength of a separation wall and enabling shrinking without fear of breakage of the separation wall even in a case of narrowing a beam width of the separation wall.

According to the present invention, for example, when a separation wall having a narrowed beam width and formed in a high-aspect-ratio vertical shape is formed, at least one protrusion contacting a bottom surface of an opening pattern is provided on a side surface of a beam. The beam is a plate-shaped member which separates common liquid chambers adjacent to each other and which is approximately vertical to a substrate in-plane direction. The protrusion is a member protruding from the beam in the substrate in-plane direction. Accordingly, even in a case in which the beam width of the separation wall is narrowed, the protrusion is structured to reinforce the beam portion of the separation wall. Thus, the separation wall with higher mechanical strength than that of a separation wall with no protrusion can be formed. The protrusion is desirably formed integrally with the substrate. The present invention is particularly suitable when an aspect ratio of the depth of the separation wall to the beam width (beam depth/beam width) is as high as 10 or higher. Hence, even when the beam width of the separation wall is narrowed, the chip size can be shrunk while restricting breakage of the separation wall. According to the present invention, further size reduction of a liquid ejection head can be achieved.

Embodiments of the present invention will now be described below, and the present invention is not limited to these embodiments.

First Embodiment

Figure 1A:
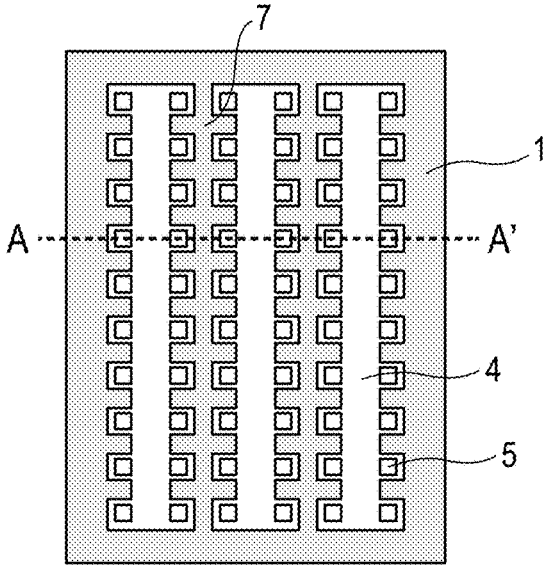
FIGS. 1A and 1B are schematic views illustrating a configuration example of a liquid ejection head according to a first embodiment of the present invention.
Figure 1B:
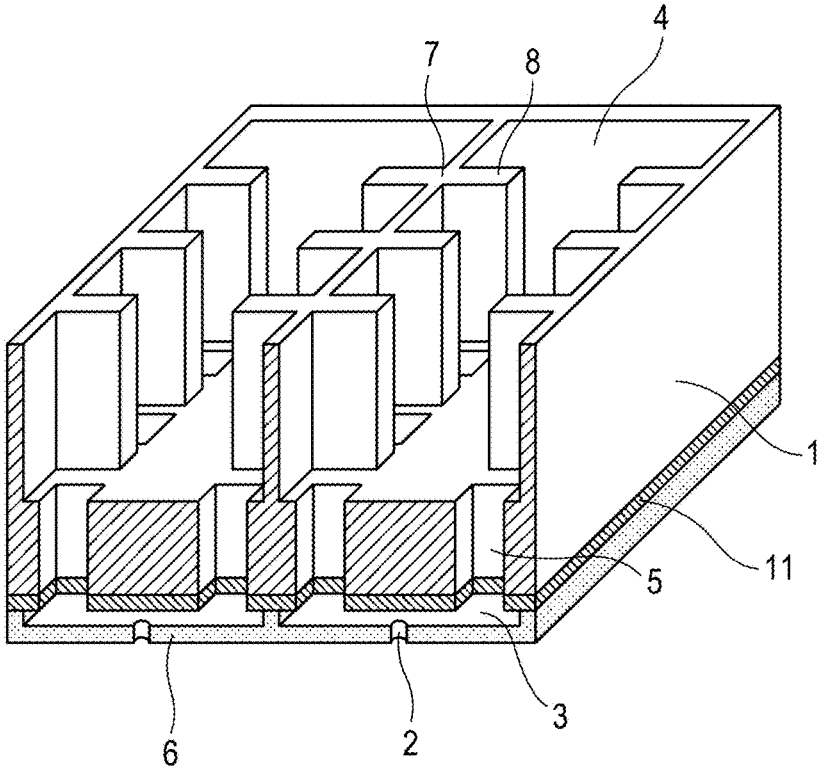

FIGS. 1A and 1B are schematic views illustrating a configuration example of a liquid ejection head according to a first embodiment of the present invention. FIG. 1A is a plan view of the liquid ejection head as seen from a side of common liquid chambers 4 (first through-passage part), and FIG. 1B is a schematic perspective view along the cross-section A-A' in FIG. 1A. It is to be noted that FIG. 1A schematically illustrates three common liquid chambers, and that FIG. 1B schematically illustrates two common liquid chambers.

In FIGS. 1A and 1B, the liquid ejection head is configured to at least include a substrate 1 made of a silicon substrate and a flow path forming member 6. In FIGS. 1A and 1B, an insulating film 11 is provided on a surface of the substrate on which the flow path forming member is provided.

The flow path forming member 6 includes a discharge port 2 ejecting liquid and a liquid flow path 3 communicating with the discharge port 2. The surface of the flow path forming member 6 is provided with a liquid-repellent layer (not illustrated) to improve ejection performance. The liquid flow path is formed between the substrate and the flow path forming member.

The substrate 1 is provided with a plurality of through-passages passing through the substrate. Each of the through-passages includes a first through-passage part (common liquid chambers 4) and a plurality of second through-passage parts (individual supply ports 5) communicating with the first through-passage part. More specifically, the substrate 1 includes the individual supply ports 5 serving as the second through-passage parts for supplying liquid to the liquid flow path 3, the common liquid chambers 4 serving as the first through-passage part communicating with the individual supply ports 5, and separation walls 7 separating the adjacent common liquid chambers 4. Each of the separation walls 7 has protrusions 8. The plurality of individual supply ports 5 are formed on the bottom surface of each common liquid chamber 4. Also, the plurality of common liquid chambers 4 are formed on one surface of the substrate on the opposite side of the other surface provided with the flow path forming member 6. Each individual supply port 5 is formed to pass through the substrate 1 from the bottom surface of the common liquid chamber 4.

The substrate 1 can include an energy-generating element, particularly an ejection-energy-generating element (labeled with reference sign 19 in FIG. 4B) for ejecting liquid such as a thermoelectric conversion element, and can include lines or the like (not illustrated) for driving the ejection-energy-generating element. The ejection-energy-generating element is formed on the substrate 1 to correspond to the position of the discharge port 2.

An opening shape of the bottom portion of the first through-passage part (common liquid chamber 4) in the substrate in-plane direction is a shape in which at least one side (for example, one side or two opposed sides) of a quadrangle is recessed due to the protrusions 8 of the separation wall 7. Meanwhile, in a case in which the bottom portion of the common liquid chamber 4 is not planar, the opening shape of the bottom portion in the substrate in-plane direction means a shape when the opening shape of the bottom portion (contour line of the opening) is projected (in a substrate normal direction) on a plane parallel to the substrate in-plane direction.

The plurality of second through-passage parts (individual supply ports 5) are arranged in the first through-passage part (common liquid chamber 4) along a beam of the separation wall in the substrate in-plane direction.

Also, the plurality of common liquid chambers serving as the through-passages are arranged to be approximately parallel to the arranging direction of the second through-passage parts. The respective common liquid chambers are arranged so that the opening shapes of the bottom portions of the respective common liquid chambers, that is, the aforementioned quadrangles, may be parallel to each other.

Although, in the structure illustrated in FIG. 1A or FIG. 1B, two rows of individual supply ports 5 are provided per common liquid chamber, the present invention is not limited to this structure. For example, in a below-mentioned structure illustrated in FIG. 8A or FIG. 8B, one row of individual supply ports 5 is provided per common liquid chamber.

The separation wall 7 separating the adjacent common liquid chambers 4 (first through-passage part) includes at least one protrusion 8 contacting the bottom portion of the first through-passage part (common liquid chamber 4). By the protrusion 8, a recess from a side of the aforementioned quadrangle (opening shape of the bottom portion of the common liquid chamber in the substrate in-plane direction)

extending in a separation wall beam direction (direction in which the beam extends) is defined. That is, the contour of the protrusion 8 forms the recess.

In the structure illustrated in FIG. 1A or FIG. 1B, the cross-sectional shape of the protrusion in the substrate in-plane direction is rectangular (may be square), and the shape and the dimension of the cross-section are uniform regardless of the depth (position in the substrate normal direction). However, the present invention is not limited to this structure. For example, in a below-mentioned structure illustrated in FIG. 4A or FIG. 4B, the cross-sectional shape of the protrusion in the substrate in-plane direction is triangular, and the dimension of the cross-section changes depending on the depth. Also, as illustrated in FIG. 3B described below, the protrusions 8 are allowed to divide the common liquid chamber in the separation wall beam direction. In this case, the opening shape of the bottom portion of the common liquid chamber 4 in the substrate in-plane direction has a plurality of regions formed by causing one quadrangle to be divided by the protrusions.

In the structure illustrated in FIG. 1A or FIG. 1B, the separation wall 7 is formed between the two adjacent common liquid chambers 4. The sidewall of the common liquid chamber 4, the sidewall of the individual supply port 5, and the sidewall of the separation wall 7 are formed approximately vertically to the front and rear surfaces of the substrate. For example, the common liquid chamber 4, the individual supply port 5, and the separation wall 7 are formed by means of dry etching processing. The common liquid chamber 4, the individual supply port 5, and the separation wall 7 are formed by means of laser processing in some cases or by means of combination thereof in other cases. The dry etching processing is suitable from a viewpoint of shape control. In this manner, since the common liquid chamber 4, the individual supply port 5, and the separation wall 7 are in approximately vertical shapes to the surface of the substrate, the common liquid chamber 4, the individual supply port 5, and the separation wall 7 can be arranged in the substrate 1 in a high-density state, and the liquid ejection head can be shrunk.

As in FIG. 1A, the plurality of individual supply ports 5 formed per common liquid chamber are arranged along the beam of the separation wall 7 between the common liquid chambers 4. Arranging the individual supply ports in the common liquid chamber linearly can cause the width of the row of individual supply ports itself to be narrowed further and can cause the row of individual supply ports to be closer to the separation wall and the adjacent row of individual supply ports than arranging the individual supply ports randomly, and a shrinking effect is thus high.

Figure 2A:
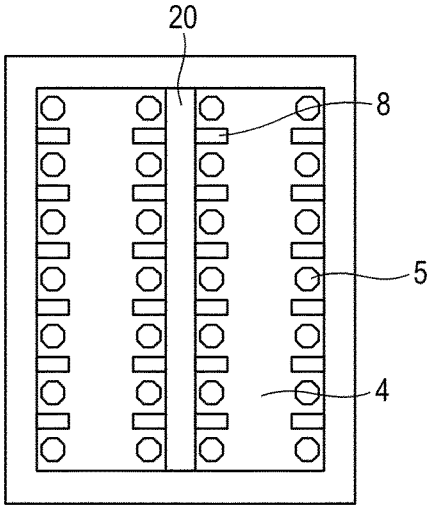
FIGS. 2A, 2B and 2C are schematic views illustrating examples of arrangement of protrusions and individual supply ports.
Figure 2B:
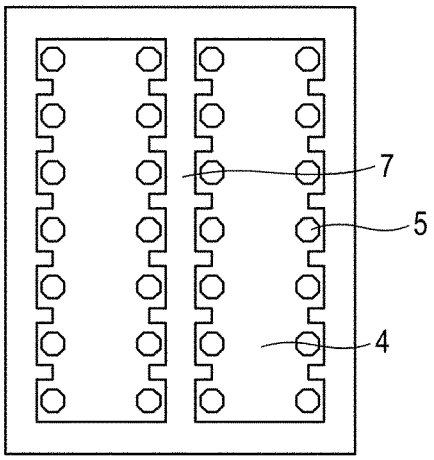
Figure 2C:
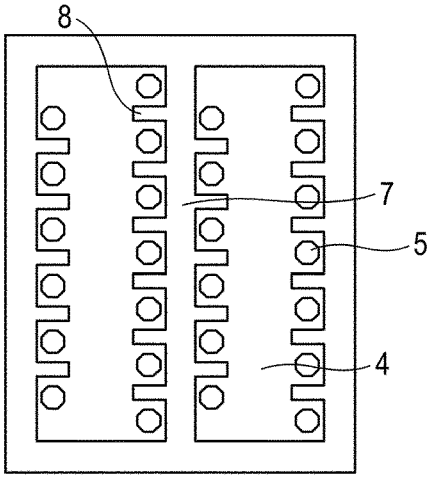

FIGS. 2A to 2C illustrate examples of structures and arrangement of the protrusions and the individual supply ports. As in FIG. 2A, the separation wall 7 includes a plate-shaped member or a beam portion 20 extending to separate the adjacent common liquid chambers 4 and walls or the protrusions 8 protruding from the beam portion toward the common liquid chambers. The protrusion 8 is formed to contact the bottom surface of the common liquid chamber 4. By reinforcing the beam portion 20 from the bottom, the protrusion 8 improves mechanical strength of the separation wall.

To obtain a structure in which the protrusions 8 contact the bottom portion of the common liquid chamber 4, the substrate is patterned to form the separation wall including the protrusions and is dug down by means of reactive ion etching serving as anisotropic etching to form the common liquid chamber. Thus, the separation wall including the protrusions and the bottom portion of the common liquid chamber are formed integrally.

To shrink the head size, it is desirable to provide the individual supply port 5 to be as close to the neighborhood of the beam portion as possible without the individual supply port 5 interfering with the protrusion 8. As in FIGS. 2A to 2C, the protrusion 8 of the separation wall is protruded from the sidewall of the beam portion 20 so that at least a part of the protrusion may be located between the two adjacent individual supply ports 5 arranged along the beam between the common liquid chambers. Also, as in FIG. 2C, in a case in which the protrusions 8 opposed with the beam portion interposed therebetween are arranged in a staggered manner, the distance between the protrusions for reinforcing the beam portion is reduced, and the separation wall 7 is improved in strength.

Figure 3A:
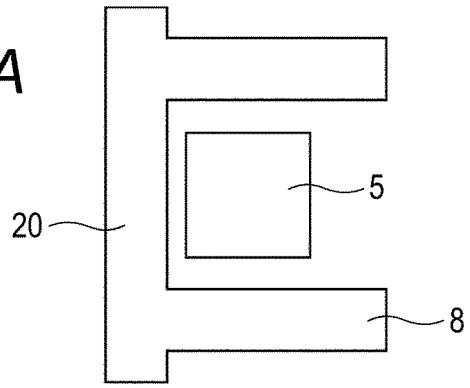
FIGS. 3A, 3B and 3C are schematic views illustrating examples of arrangement of the protrusions and the individual supply ports.
Figure 3B:
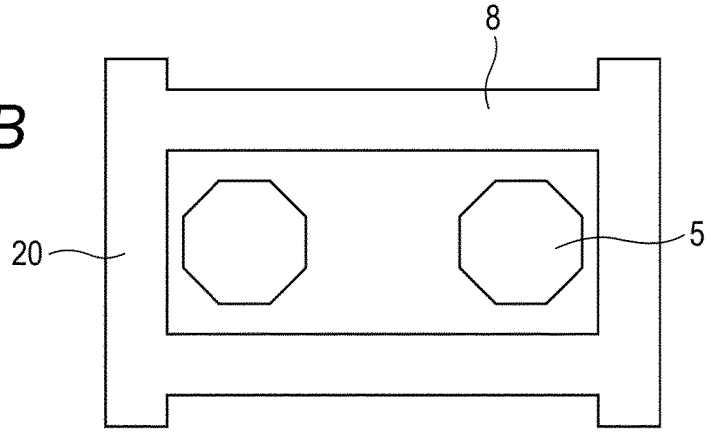
Figure 3C:
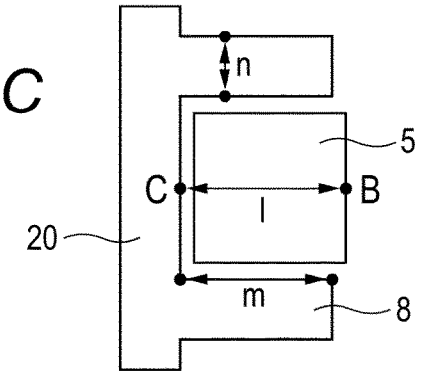

FIGS. 3A to 3C are enlarged views of the neighborhoods of the protrusions 8 and the individual supply ports 5 (second through-passage parts). As in FIG. 3A, when the protrusion 8 is longer (length in the substrate in-plane direction), the area of the protrusion 8 contacting the bottom surface of the common liquid chamber is larger, and the reinforcing effect is higher. This facilitates improvement in mechanical strength. In this respect, as in FIG. 3A, the protrusion 8 desirably protrudes further than the individual supply port 5 (the width of the protrusion 8 is longer than that of the individual supply port 5 in an equal direction). Also, as in FIG. 3B, the protrusion 8 may extend and reach the adjacent beam portion to divide the common liquid chamber. In other words, a recess from a side of the quadrangle may reach an opposite side of the quadrangle. In this case, the opening shape of the bottom portion of the common liquid chamber 4 in the substrate in-plane direction has a plurality of regions (for example, rectangles) formed by causing one quadrangle to be divided. The recess is a region existing in each of the plurality of regions formed by causing the common liquid chamber to be divided by the protrusions. In this manner, the "recess" in the present specification is a term including the meaning of a case in which a recess from a side reaches an opposite side. Meanwhile, as in FIG. 3B, although the protrusion can be formed by connecting the opposed sides of the common liquid chamber, the common liquid chamber is required to communicate with any of the individual supply ports in the common liquid chamber. Thus, in the case in FIG. 3B, to cause the respective regions of the common liquid chamber divided by the protrusions to communicate with each other in the separation wall beam direction, the upper portion of each protrusion can be recessed by means of etching or laser processing, for example.

Also, as illustrated in FIG. 3C, from a viewpoint of shrinking, a length m of the protrusion in the substrate in-plane direction is desirably a distance between a point B and a point C or less (the distance between the points B and C is referred to as a distance l). The point B is a farthest point from the beam portion 20 of the separation wall on the circumference of the opening of the individual supply port in the bottom portion of the common liquid chamber. The point C is an intersection point between a vertical line drawn from the point B toward the beam portion of the separation wall and the sidewall of the beam portion of the separation wall. In a case of $m \leq l$, the protrusion will not protrude to go over the individual supply port, and shrinking is available regardless of the existence of the protrusion. Meanwhile, in a case in which the length m of the protrusion is uniform regardless of the depth as in FIG. 1B, the uniform length m is desirably equal to or less than the distance l. Also, as in a below-mentioned case in FIG. 4B, in a case in which the length m of the protrusion changes in the depth direction, the length m is desirably equal to or less than the distance l at any depth.

When the area of the protrusion 8 contacting the sidewall of the beam portion is larger, the reinforcing effect is higher. Thus, from a viewpoint of the reinforcing effect, a width n (thickness in a direction perpendicular to a direction of the length m) of the protrusion 8 is desirably longer.

Figure 4A:
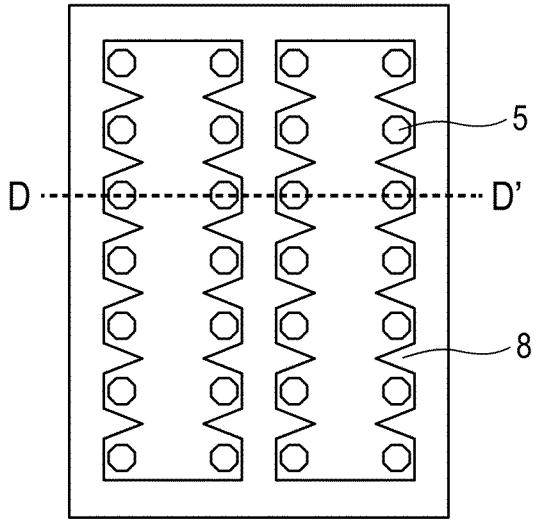
FIGS. 4A and 4B are schematic views illustrating another configuration example of the liquid ejection head.
Figure 4B:
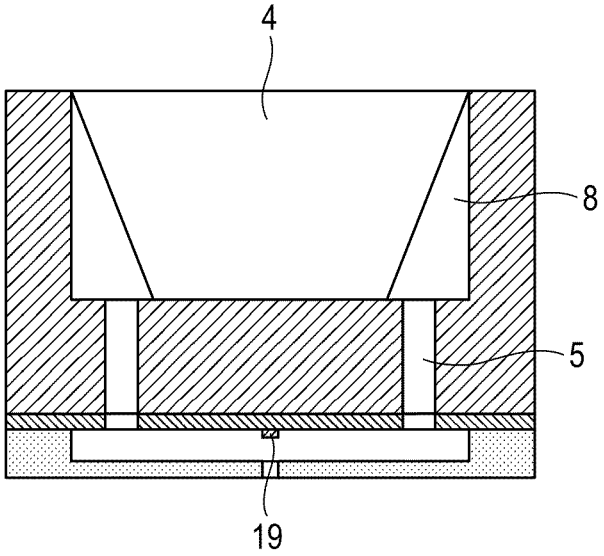

The shape of the protrusion 8 is not limited as long as the protrusion 8 contacts the bottom surface of the common liquid chamber and the sidewall of the beam portion, and as long as the shape is effective in reinforcing the beam portion. For example, the protrusion 8 may be in a shape as in FIG. 4A or FIG. 4B. FIG. 4A is a plan view of the liquid ejection head as seen from a side of the common liquid chambers 4 (first through-passage part), and FIG. 4B is a schematic cross-sectional view along the cross-section D-D' in FIG. 4A. It is to be noted that FIG. 4A schematically illustrates two common liquid chambers, and that FIG. 4B schematically illustrates one common liquid chamber. In this example, the cross-sectional shape of the protrusion in the substrate in-plane direction is triangular. The length m decreases from the bottom portion to the top portion of the common liquid chamber and becomes zero at the top portion of the common liquid chamber (position at a depth of zero).

In a case in which the separation wall 7 has at least one protrusion 8, this exerts the reinforcing effect for the separation wall. However, the more the number of protrusions is, the further the number of positions in which the beam of the separation wall is reinforced increases. Thus, the protrusion is desirably arranged at every available position.

Second Embodiment

Figure 5A:
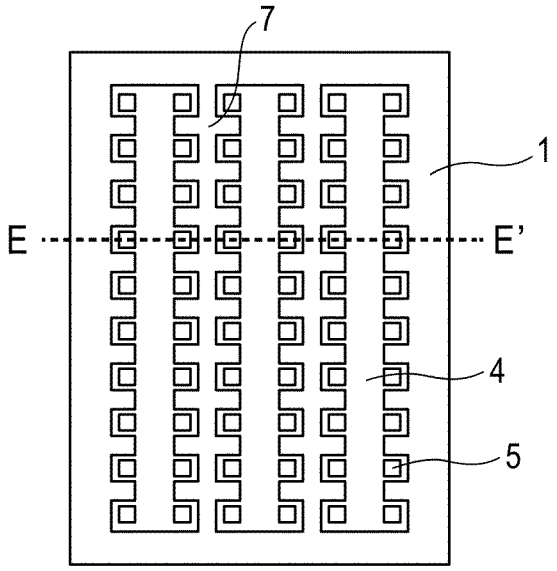
FIGS. 5A and 5B are schematic views illustrating a configuration example of a liquid ejection head according to a second embodiment of the present invention.
Figure 5B:
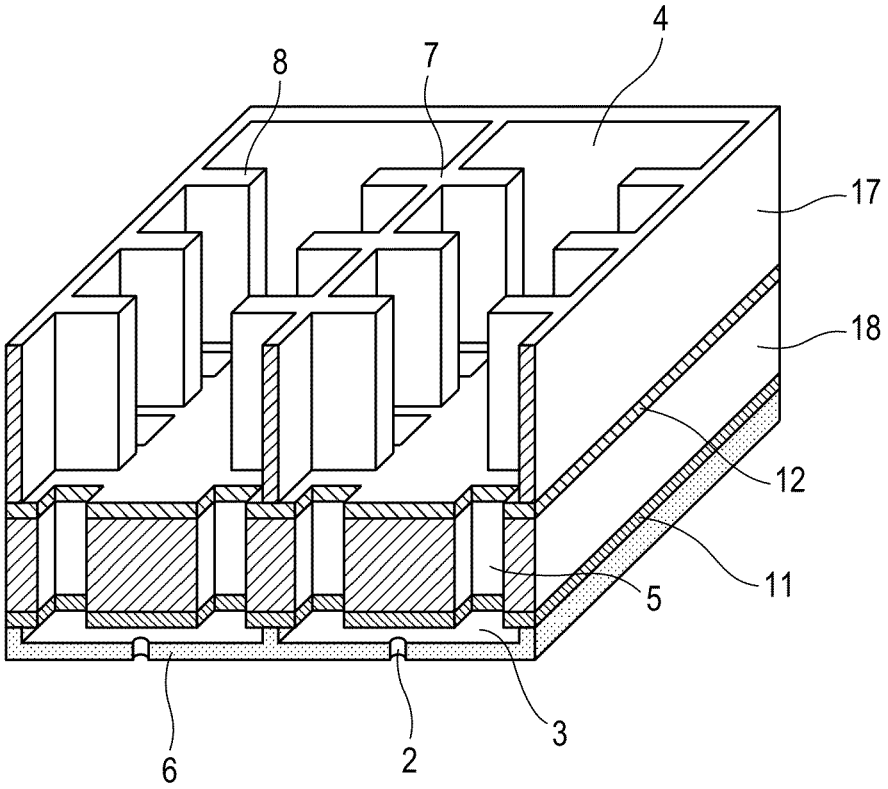

FIGS. 5A and 5B are schematic views illustrating a configuration example of a liquid ejection head according to a second embodiment of the present invention. Description of similar parts to those in the aforementioned embodiment is omitted. FIG. 5A is a plan view of the liquid ejection head as seen from a side of the common liquid chambers (first through-passage part), and FIG. 5B is a schematic perspective view along the cross-section E-E' in FIG. 5A. A substrate includes the energy-generating element 19. It is to be noted that FIG. 5A schematically illustrates three common liquid chambers, and that FIG. 5B schematically illustrates two common liquid chambers. In the present embodiment, as illustrated in FIG. 5B, instead of the substrate in the first embodiment, a substrate including a first substrate, a second substrate, and an intermediate layer provided between the first substrate and the second substrate is used. The intermediate layer is a layer that can stop etching of the common liquid chamber. More specifically, an SOI substrate in which an intermediate layer (silicon oxide film) 12 resides between a first silicon substrate 17 and a second silicon substrate 18 can be used.

As a material for the intermediate layer, a resin material, silicon oxide, silicon nitride, silicon carbide, a metal other than silicon, metal oxide thereof, metal nitride thereof, or the like can be used. That is, the material for the intermediate layer can be a resin layer, a silicon oxide film, a silicon nitride film, a silicon carbide film, a metal film other than silicon, a metal oxide film thereof, a metal nitride film thereof, or the like. An example of the resin layer that can be raised is a photosensitive resin layer. Among others, the photosensitive resin layer or the silicon oxide film is desirably used as the intermediate layer for easy formation. In a case of using a substrate other than the SOI substrate, the first substrate is provided with the common liquid chambers, the second substrate is provided with the individual supply ports, and the respective substrates are connected via an adhesive.

Figure 6A:
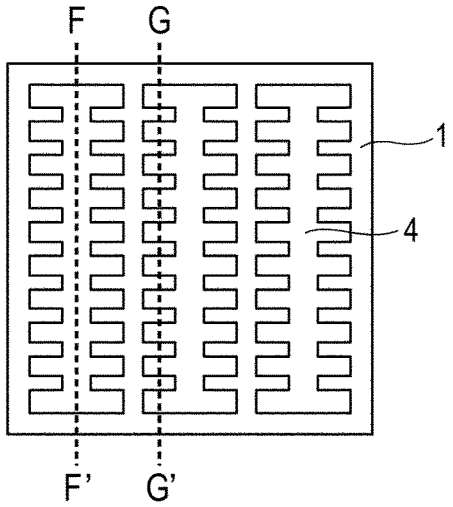
FIGS. 6A, 6B and 6C are schematic views illustrating a micro-loading effect.
Figure 6B:
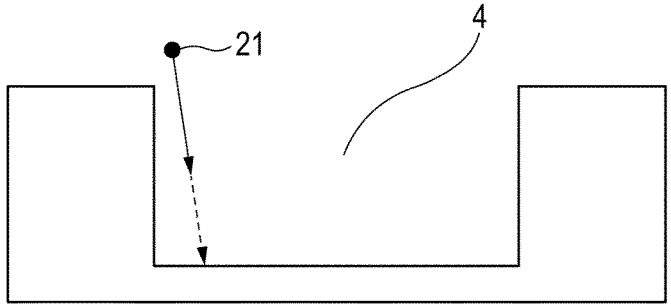
Figure 6C:
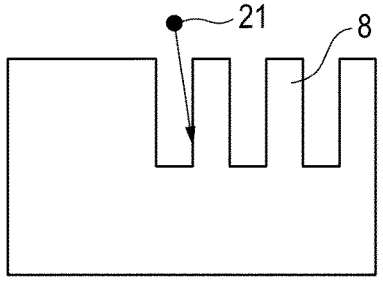

In an opening pattern in FIG. 6A, a position in which the opening width is long as in the cross-section F-F' and a position in which the opening width is short as in the cross-section G-G' are mixed. In a case of dry etching of such a pattern, in the position in which the opening width is long as in FIG. 6B, an ion 21 hardly collides with the sidewall and easily reaches the bottom surface. Conversely, in the position in which the opening width is short, the ion 21 collides with the sidewall and highly possibly fails to reach the bottom surface. Thus, a phenomenon called a micro-loading effect, in which the etching rate varies depending on the difference in opening width, may occur.

Figure 7A:
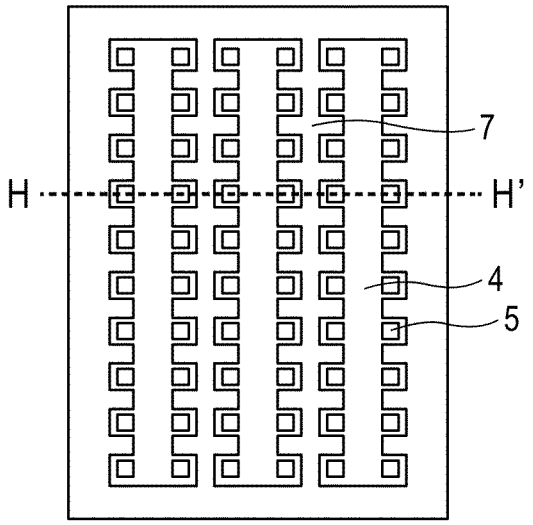
FIGS. 7A and 7B are schematic views of a liquid ejection head illustrating the micro-loading effect.
Figure 7B:
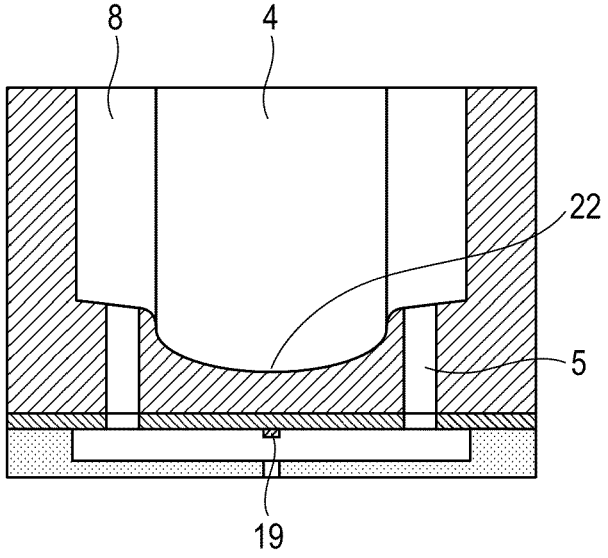

For example, as in FIG. 7A, in an opening pattern forming the common liquid chamber, a part interposed between the protrusions of the separation wall 7 is lower in etching rate and may be processed to be shallower than a large part with no protrusions. FIG. 7A is a plan view of a liquid ejection head as seen from a side of the common liquid chambers (first through-passage part), and FIG. 7B is a schematic cross-sectional view along the cross-section H-H' in FIG. 7A. It is to be noted that FIG. 7A schematically illustrates three common liquid chambers, and that FIG. 7B schematically illustrates one common liquid chamber. That is, when the opening pattern as in FIG. 7A is dry-etched, the bottom portion of the common liquid chamber may be provided with a deeper position than the opening portion of the individual supply port 5 communicating with the common liquid chamber. For example, a deepest part 22 may be formed around the center of the common liquid chamber in the shorter-side direction. In such a configuration, there is a part in which liquid reversely flows from the lower part to the higher part, which may restrict liquid from flowing at the time of liquid supply. Also, in a case in which the volume of silicon around the ejection-energy-generating element 19 decreases, a dissipation efficiency of heat generated in the ejection-energy-generating element 19 is lowered, which may influence ejection.

To solve such a problem, the SOI substrate including the silicon oxide film 12, which effectively functions as a stop layer for dry etching, is desirably used. As illustrated in FIG. 5B, the common liquid chambers 4 are processed in the first silicon substrate 17 with use of the SOI substrate. At this time, although the first silicon substrate 17 is etched down to the silicon oxide film 12 earlier at a position with the higher etching rate due to the micro-loading effect, the etching stops at the silicon oxide film 12. Thus, the etching depth can be equal to that at a position with the lower etching rate at which the first silicon substrate 17 is etched down to the silicon oxide film 12 later. Subsequently, the silicon oxide film on the bottom surface of the common liquid chamber is patterned in a shape of the individual supply port 5, the second silicon substrate 18 is dry-etched again from the first silicon substrate side to form the individual supply port 5 in the second silicon substrate 18, and the individual supply port 5 can communicate with the common liquid chamber 4. That is, the common liquid chamber passes through the first substrate and does not pass through the intermediate layer and the second substrate. The individual supply port 5 passes through the intermediate layer and the second substrate. With such a configuration, it is possible to manufacture the liquid ejection head enabling the depth distribution in the common liquid chamber to be restricted and enabling the shape thereof to be controlled in a stable manner.

Third Embodiment

Figure 8A:
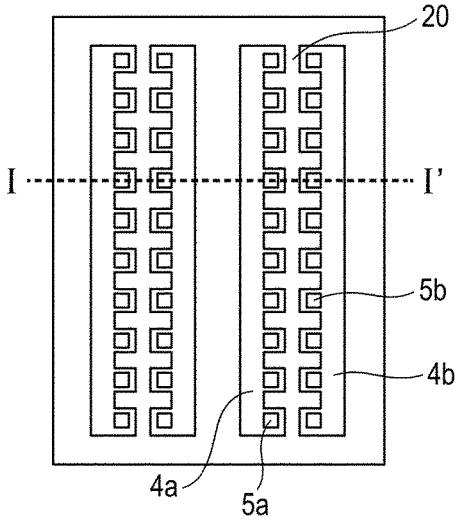
FIGS. 8A and 8B are schematic views illustrating a configuration example of a liquid ejection head according to a third embodiment of the present invention.
Figure 8B:
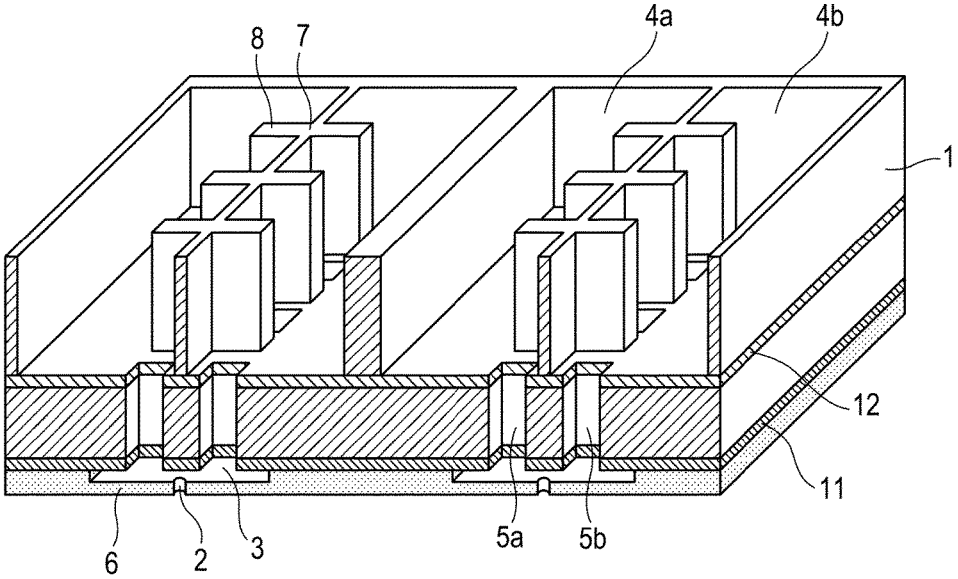

FIGS. 8A and 8B are schematic views illustrating a configuration example of a liquid ejection head according to a third embodiment of the present invention. Description of similar parts to those in the aforementioned embodiments is omitted. FIG. 8A is a plan view of the liquid ejection head as seen from a side of the common liquid chambers (first through-passage part), and FIG. 8B is a schematic perspective view along the cross-section I-I' in FIG. 8A.

In the present embodiment, as illustrated in FIG. 8A or FIG. 8B, two rows of individual supply ports (a row of individual supply ports 5*a* and a row of individual supply ports 5*b*) arrayed in the extending direction of the beam portion 20 in two common liquid chambers 4*a* and 4*b*, respectively, are arranged to be opposed to each other with the separation wall 7 including the protrusions 8 interposed therebetween. The two rows of individual supply ports are formed to communicate with the same liquid flow path 3. That is, as for a pair of adjacent through-passages, the common liquid chamber 4*a* in one through-passage and the common liquid chamber 4*b* in the other through-passage communicate with each other via one liquid flow path 3.

Thus, liquid flowing in a certain common liquid chamber can pass through an individual supply port communicating with the common liquid chamber and the liquid flow path 3, flow into an adjacent individual supply port, and reach a different common liquid chamber. That is, liquid supplied from an outside to the liquid ejection head is supplied via a common inflow path (common liquid chamber 4*a* on an inflow side) and an individual inflow port (individual supply port 5*a* on the inflow side) to the liquid flow path 3. The liquid can thereafter flow outside via an individual outflow port (individual supply port 5*b* on an outflow side) and a common outflow path (common liquid chamber 4*b* on the outflow side). In this manner, in the pair of adjacent supply ports, the common inflow path (common liquid chamber 4*a* on the inflow side) functions as a liquid inflow port, and the common outflow path (common liquid chamber 4*b* on the outflow side) functions as a liquid outflow port, to enable a forced liquid flow (circulating liquid flow) to be generated. That is, liquid in the pressure chamber including the energy-generating element is circulated between the inside and the outside of the pressure chamber. In a normal configuration with no circulating liquid flow, liquid around the discharge port 2 may be evaporated to cause a decrease in ejection speed and alteration of color material concentration of print dots. However, due to this circulating liquid flow, the liquid state around the discharge port can be kept constant, and the possibility of the printing alteration can thus be reduced.

Meanwhile, in the individual supply port 5*b*, not supply of liquid (to the discharge port) but discharge of liquid is performed. However, in this context, the individual supply port 5*b* is referred to as the "supply port" for convenience. The individual supply port on the outflow side means the second through-passage part on the outflow side.

In the present embodiment as well, by shortening the beam width of the separation wall 7 to cause the individual inflow port 5*a* and the individual outflow port 5*b* to be closer to the beam portion 20, the liquid ejection head size can be shrunk. Also, since the individual inflow port (5*a*) and the individual outflow port (5*b*) are provided to be close to the ejection-energy-generating element to improve refilling performance of liquid, high-speed printing can be performed.

Also, it is desirable for the stable circulating liquid flow to arrange the individual inflow port (5*a*) and the individual outflow port (5*b*) symmetrically across the discharge port 2. Thus, a favorable positional relationship between the individual inflow port (5*a*) and the individual outflow port (5*b*) is to arrange the individual outflow port (5*b*) with respect to the individual inflow port (5*a*) in a 90-degree direction to the arrangement of the individual inflow ports (5*a*) in the substrate in-plane direction. That is, it is desirable to arrange the individual supply port 5*b* or 5*a* in the other through-passage with respect to the individual supply port 5*a* or 5*b* in one through-passage in a direction perpendicular to the arranging direction of the individual supply ports 5*a* or 5*b*, the individual supply ports communicating with each other via one liquid flow path 3.

Meanwhile, in the structure illustrated in FIG. 1A or FIG. 1B, the two individual supply ports 5 communicating with each other via one liquid flow path 3 and adjacent to each other in a direction perpendicular to the beam extending direction communicate with the same common liquid chamber 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-243420, filed Dec. 15, 2016, which is hereby incorporated by reference herein in its entirety.

What is claimed is:

1. A liquid ejection head comprising:

a substrate including an energy-generating element;

a flow path forming member including a discharge port and defining a liquid flow path formed between the flow path forming member and the substrate; and a plurality of through-passages passing through the substrate, each of the through-passages including a first through-passage part serving as a common liquid chamber and a plurality of second through-passage parts communicating with the first through-passage part, wherein a separation wall separating the adjacent first through-passage parts includes a plate-shaped member separating the adjacent first through-passage parts and approximately vertical to a substrate in-plane direction and, at least one protrusion protruding from the plate-shaped member in the substrate in-plane direction and contacting a bottom portion of the first through-passage part.

2. The liquid ejection head according to claim 1, wherein an aspect ratio of the separation wall, which is a ratio of a depth to a width of the plate-shaped member, is 10 or higher.

3. The liquid ejection head according to claim 2, wherein an opening shape of the bottom portion of the first through-passage part in the substrate in-plane direction is a shape in which a quadrangle has a recess, and the recess is defined by the protrusion.

4. The liquid ejection head according to claim 3, wherein the first through-passage parts of the plurality of through-passages are arranged so that the quadrangles may be approximately parallel.

5. The liquid ejection head according to claim 2, wherein, in the substrate in-plane direction, the plurality of second through-passage parts are arranged along the plate-shaped member.

6. The liquid ejection head according to claim 2, wherein, in the substrate in-plane direction, at least a part of the protrusion is located between two second through-passage parts adjacent to each other along the plate-shaped member.

7. The liquid ejection head according to claim 2, wherein, in the substrate in-plane direction, a length of the protrusion is equal to or less than a distance between a farthest point from the plate-shaped member on a circumference of an opening of one of the second through-passage parts in the bottom portion of the first through-passage part and an intersection point between a vertical line drawn from the point toward the plate-shaped member and a sidewall of the plate-shaped member.

8. The liquid ejection head according to claim 2, wherein the substrate includes a first substrate, a second substrate, and an intermediate layer provided between the first substrate and the second substrate, wherein the first through-passage part passes through the first substrate and does not pass through the intermediate layer and the second substrate, and wherein at least one of the second through-passage parts passes through the intermediate layer and the second substrate.

9. The liquid ejection head according to claim 2, wherein, as for a pair of adjacent through-passages, one of the second through-passage parts in one through-passage and another of the second through-passage parts in another through-passage communicate with each other via the liquid flow path.

10. The liquid ejection head according to claim 9, wherein the second through-passage part in the other through-passage is arranged with respect to the second through-passage part in the one through-passage in a direction perpendicular to an arranging direction of the second through-passage parts, the second through-passage parts communicating with each other via the liquid flow path.

11. The liquid ejection head according to claim 1, wherein an opening shape of the bottom portion of the first through-passage part in the substrate in-plane direction is a shape in which a quadrangle has a recess, and the recess is defined by the protrusion.

12. The liquid ejection head according to claim 11, wherein the first through-passage parts of the plurality of through-passages are arranged so that the quadrangles may be approximately parallel.

13. The liquid ejection head according to claim 11, wherein, in the substrate in-plane direction, the plurality of second through-passage parts are arranged along the plate-shaped member.

14. The liquid ejection head according to claim 11, wherein, in the substrate in-plane direction, at least a part of the protrusion is located between two of the second through-passage parts adjacent to each other along the plate-shaped member.

15. The liquid ejection head according to claim 1, wherein, in the substrate in-plane direction, the plurality of second through-passage parts are arranged along the plate-shaped member.

16. The liquid ejection head according to claim 1, wherein, in the substrate in-plane direction, at least a part of the protrusion is located between two second through-passage parts adjacent to each other along the plate-shaped member.

17. The liquid ejection head according to claim 1, wherein, in the substrate in-plane direction, a length of the protrusion is equal to or less than a distance between a farthest point from the plate-shaped member on a circumference of an opening of one of the second through-passage parts in the bottom portion of the first through-passage part and an intersection point between a vertical line drawn from the point toward the plate-shaped member and a sidewall of the plate-shaped member.

18. The liquid ejection head according to claim 1, wherein the substrate includes a first substrate, a second substrate, and an intermediate layer provided between the first substrate and the second substrate, wherein the first through-passage part passes through the first substrate and does not pass through the intermediate layer and the second substrate, and wherein one of the second through-passage parts passes through the intermediate layer and the second substrate.

19. The liquid ejection head according to claim 1, wherein, as for a pair of adjacent through-passages, one of the second through-passage parts in one through-passage and another second through-passage part in another through-passage communicate with each other via the liquid flow path.

20. The liquid ejection head according to claim 19, wherein the other second through-passage part in the other through-passage is arranged with respect to the second through-passage part in the one through-passage in a direction perpendicular to an arranging direction of the second through-passage parts, the second through-passage parts communicating with each other via the liquid flow path.

* * * * *